US010793800B2

(12) United States Patent
Henderson

(10) Patent No.: US 10,793,800 B2
(45) Date of Patent: Oct. 6, 2020

(54) LUBRICANT COMPOSITIONS AND METHODS OF USE

(71) Applicant: Aero Accessories, LLC, Gibsonville, NC (US)

(72) Inventor: Timothy H. Henderson, Gibsonville, NC (US)

(73) Assignee: Aero Accessories, LLC, Gibsonville, NC (US)

( * ) Notice: Subject to any disclaimer, the term of this patent is extended or adjusted under 35 U.S.C. 154(b) by 68 days.

(21) Appl. No.: 15/885,982

(22) Filed: Feb. 1, 2018

(65) Prior Publication Data

US 2018/0223209 A1 Aug. 9, 2018

Related U.S. Application Data

(60) Provisional application No. 62/455,841, filed on Feb. 7, 2017.

(51) Int. Cl.

| | |
|---|---|
| ***C10M 103/02*** | (2006.01) |
| ***C10M 159/00*** | (2006.01) |
| ***C10M 177/00*** | (2006.01) |
| ***C10M 173/02*** | (2006.01) |
| *C10N 50/02* | (2006.01) |
| *C10N 40/34* | (2006.01) |
| *C10N 50/00* | (2006.01) |

(52) U.S. Cl.

CPC ..... *C10M 103/02* (2013.01); *C10M 159/00* (2013.01); *C10M 173/02* (2013.01); *C10M 177/00* (2013.01); *C10M 2201/02* (2013.01); *C10M 2201/041* (2013.01); *C10N 2040/34* (2013.01); *C10N 2050/02* (2013.01); *C10N 2050/025* (2020.05)

(58) Field of Classification Search

CPC ..... C10M 103/02; C10M 113/02; C10M 173/02; C10M 2201/041; C10N 2250/12; C10N 2250/121

See application file for complete search history.

(56) References Cited

U.S. PATENT DOCUMENTS

| | | | | |
|---|---|---|---|---|
| 4,052,323 | A * | 10/1977 | Feneberger | C10M 169/044 508/118 |
| 4,281,528 | A * | 8/1981 | Spiegelberg | B21J 3/00 72/28.1 |
| 4,289,804 | A * | 9/1981 | Labate | B03C 3/84 106/475 |
| 5,445,748 | A * | 8/1995 | Holinski | C10M 103/00 106/38.27 |
| 5,492,639 | A * | 2/1996 | Schneider | C10M 169/044 508/126 |
| 6,177,386 | B1 * | 1/2001 | Aurin | C10M 125/24 508/125 |
| 9,404,058 | B2 * | 8/2016 | Hasegawa | C10M 125/02 |
| 2004/0156995 | A1 * | 8/2004 | Komiyama | C04B 28/26 427/376.2 |
| 2004/0164438 | A1 * | 8/2004 | Lamport | F16D 69/026 264/86 |
| 2007/0105727 | A1 * | 5/2007 | Doi | C10M 173/02 508/167 |
| 2009/0305052 | A1 * | 12/2009 | Handl | C10M 173/02 428/426 |
| 2011/0046027 | A1 * | 2/2011 | Zhamu | C10M 103/02 508/113 |
| 2012/0288649 | A1 * | 11/2012 | Blackwood | B60R 21/235 428/35.2 |
| 2012/0304792 | A1 * | 12/2012 | Mayr | C10M 173/02 74/412 R |

* cited by examiner

*Primary Examiner* — Ellen M McAvoy
(74) *Attorney, Agent, or Firm* — F. Michael Sajovec; Douglas C. Tsao; Williams Mullen

(57) ABSTRACT

The present disclosure relates to lubricant compositions for use on engine components. The lubricant compositions include, by volume: 30 to 50% graphite in alcohol solution; 0.1 to 5% surfactant; and 40 to 70% water. The present disclosure also relates to processes for preparing lubricant compositions and methods of using such compositions.

12 Claims, No Drawings

LUBRICANT COMPOSITIONS AND METHODS OF USE

CROSS-REFERENCE TO RELATED APPLICATION

This application claims priority to U.S. Provisional Application Ser. No. 62/455,841, filed Feb. 7, 2017, the disclosure of which is incorporated by reference in its entirety.

FIELD

The present disclosure relates to lubricant compositions for use with engine components. The present disclosure also relates to processes for preparing lubricant compositions and methods of using such compositions.

BACKGROUND

Previous lubricant or friction reducing compositions are disclosed, for example, in the following: U.S. Patent Application Publication No. US20040164438, U.S. Patent Application Publication No. US20120288649, and U.S. Pat. No. 9,404,058. These applications and patents pertain, in various ways, to creating lubricant compositions using a solid lubricant, such as graphite.

BRIEF SUMMARY

The present disclosure relates to lubricant compositions for use with engine components. The lubricant composition comprises graphite in alcohol solution, surfactant, and water. One embodiment may comprise, by volume: 30 to 50% graphite in alcohol solution; 0.1 to 5% surfactant; and 40 to 70% water.

The present disclosure also relates to processes for preparing lubricant compositions of the invention comprising mixing the graphite with an alcohol solution, mixing the graphite in alcohol solution with water, and mixing the surfactant into the graphite and water mixture.

The present disclosure also relates to a method of using the lubricant compositions of the invention and includes applying the lubricant composition to a surface and allowing the lubricant composition to dry.

DESCRIPTION

In the following detailed description, embodiments of the present invention are described in detail to enable practice of the invention.

Although the invention is described with reference to these specific embodiments, it should be appreciated that the invention can be embodied in different forms and should not be construed as limited to the embodiments set forth herein. Rather, these embodiments are provided so that this disclosure will be thorough and complete, and will fully convey the scope of the invention to those skilled in the art.

The terminology used in the description of the invention herein is for the purpose of describing particular embodiments only and is not intended to be limiting of the invention. As used in the description of the invention and the appended claims, the singular forms "a," "an" and "the" are intended to include the plural forms as well, unless the context clearly indicates otherwise. The invention includes numerous alternatives, modifications, and equivalents as will become apparent from consideration of the following detailed description.

It will be understood that although the terms "first," "second," "third," "a)," "b)," and "c)," etc. may be used herein to describe various elements of the invention should not be limited by these terms. These terms are only used to distinguish one element of the invention from another. Thus, a first element discussed below could be termed an element aspect, and similarly, a third without departing from the teachings of the present invention. Thus, the terms "first," "second," "third," "a)," "b)," and "c)," etc. are not intended to necessarily convey a sequence or other hierarchy to the associated elements but are used for identification purposes only. The sequence of operations (or steps) is not limited to the order presented in the claims.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the present application and relevant art and should not be interpreted in an idealized or overly formal sense unless expressly so defined herein. The terminology used in the description of the invention herein is for the purpose of describing particular embodiments only and is not intended to be limiting of the invention. All publications, patent applications, patents and other references mentioned herein are incorporated by reference in their entirety. In case of a conflict in terminology, the present specification is controlling.

Also as used herein, "and/or" refers to and encompasses any and all possible combinations of one or more of the associated listed items, as well as the lack of combinations when interpreted in the alternative ("or").

Unless the context indicates otherwise, it is specifically intended that the various features of the invention described herein can be used in any combination. Moreover, the present invention also contemplates that in some embodiments of the invention, any feature or combination of features set forth herein can be excluded or omitted. To illustrate, if the specification states that a complex comprises components A, B and C, it is specifically intended that any of A, B or C, or a combination thereof, can be omitted and disclaimed.

As used herein, the transitional phrase "consisting essentially of" (and grammatical variants) is to be interpreted as encompassing the recited materials or steps "and those that do not materially affect the basic and novel characteristic(s)" of the claimed invention. See, In re Herz, 537 F.2d 549, 551-52, 190 U.S.P.Q. 461, 463 (CCPA 1976) (emphasis in the original); see also MPEP § 2111.03. Thus, the term "consisting essentially of" as used herein should not be interpreted as equivalent to "comprising."

The term "about," as used herein when referring to a measurable value, such as, for example, an amount or concentration and the like, is meant to encompass variations of ±20%, ±10%, ±5%, ±1%, ±0.5%, or even ±0.1% of the specified amount. A range provided herein for a measureable value may include any other range and/or individual value therein.

Friction between mechanical components such as engine components is undesirable under many circumstances. For example, the static friction between a rubber oil filter seal and an engine filter mount pad can cause the oil filter to become "stuck" and difficult to unscrew from the engine. Sometimes, the filter is so "stuck" that the wrenching nut provided on the end of the filter case will tear off of the metal case without the filter beginning to unscrew from the engine.

Mechanics often have to resort to innovative methods of freeing the oil filter, such as driving a screwdriver or other metal rod through the filter from side to side and using it as a lever to force the filter to unscrew. Such methods create hazards, such as the filter parts breaking off and moving into the engine oil passages, creating the potential for engine damage or engine failure.

Attempts to address this problem of friction between mechanical components have included putting engine oil and/or forms of grease, such as Dow Corning® 4 Electrical Insulating Compound ("DC4"), onto the seal prior to the filter being installed on the engine. Such solutions, however, have had limited success. One reason for the limited success is that the viscosity of a semi-solid rubber seal is higher than the viscosity of motor oil, grease, or DC4. Because of the constant pressure on the seal and its higher viscosity, any liquid-type lubricant between the two components is constantly urged to escape or be squeezed out. In contrast, dry lubricants, such as graphite, exhibit higher viscosity than rubber and are likely to provide better lubrication. A disadvantage of dry lubricants is that they are not as effective at adhering to a surface and are more likely to be removed or fall off during handling and shipping.

The present invention discloses lubricant compositions that exhibit higher viscosity than rubber and which are capable of providing lubrication between mechanical components. The lubricant compositions may comprise 30 to 50% graphite in alcohol solution, 0.1 to 5% surfactant, and 40 to 70% water. The graphite in alcohol solution may comprise Bakerlube™ WG, available from ROCOL, Leeds, UK, a high temperature water-based graphited lubricant, placed in a 70% isopropyl alcohol solution (distilled or deionized water is preferred). The surfactant may be a nonionic surfactant, anionic surfactant, cationic surfactant, nonionic surfactant, or zwitterionic surfactant. In one embodiment, the surfactant may be a nonionic surfactant such as SURTECH 502®, available from Surface Chemists of Florida, Jupiter, Fla. In one embodiment, the water is distilled water or deionized water.

In one embodiment, the percentage by volume of graphite in alcohol solution is 32.2 to 49.5%, the percentage by volume of surfactant is 1.0 to 3.5%, and the percentage by volume of water is 48.25 to 66%. In one embodiment, the percentage of surfactant by volume is 1.9 to 2.8 percent.

The present invention also discloses methods of preparing lubricant compositions. A water-based, graphited lubricant, such as Bakerlube™ WG, may be diluted in a 70% isopropyl alcohol solution. The graphite in alcohol solution may next be thoroughly mixed with water (distilled or deionized water is preferred). Next, a liquid surfactant may be added to the mixture.

The present invention also discloses methods of using lubricant compositions. The method comprising applying the lubricant composition to a surface and allowing the lubricant composition to dry. The lubricant may be applied by a brush, a spray, a person's hand, or some other mechanical means. The lubricant composition may be applied to a surface of an engine component, such as the surface of an oil filter seal, and allowed to dry. The lubricant may be applied to a surface to form a film less than 0.01 inches thick. Optionally, the lubricant composition may be applied to a surface to form a film 0.002 to 0.003 inches thick. The lubricant composition typically will dry in about a minute in free air at a temperature of 70-80 degrees Fahrenheit. Drying may be accelerated by warm air (150-200 degrees Fahrenheit) or by use of fans.

Different ratios of graphite in alcohol solution to water may be used to obtain different strengths of lubricant. For example, for a one part graphite in alcohol solution to one part water solution placed on an oil filter torqued on using 16-18 ft./lb. of pressure, the filter may be torqued off using about 20 ft./lb. For a one part graphite in alcohol solution to two parts water solution placed on a filter torqued on using 16-18 ft./lb. of pressure, the filter may be torqued off using about 30 ft./lb.

Having thus described certain embodiments of the present invention, it is to be understood that the invention defined by the appended claims is not to be limited by particular details set forth in the above description as many apparent variations thereof are possible without departing from the spirit or scope thereof as hereinafter claimed.

What is claimed is:

1. A lubricant composition consisting essentially by volume:

30 to 50% of a graphite in alcohol solution, the graphite in alcohol solution comprising between 10 to 30% by volume of graphite placed in an alcohol solution;

0.1 to 5% surfactant; and 40 to 70% water.

2. The lubricant composition of claim 1, wherein the percentage by volume of graphite in alcohol solution is 32.2 to 49.5%, the percentage by volume of surfactant is 1.0 to 3.5%, and the percentage by volume of water is 48.25 to 66%.

3. The lubricant composition of claim 1, wherein the percentage of surfactant by volume is 1.9 to 2.8%.

4. The lubricant composition of claim 1, wherein the surfactant is selected from the group consisting of nonionic surfactants, anionic surfactants, cationic surfactants, nonionic surfactants, and zwitterionic surfactants.

5. The lubricant composition of claim 4, wherein the surfactant is a nonionic surfactant.

6. A process for preparing a lubricant composition consisting essentially of i) 30 to 50% graphite in alcohol solution comprising between 10 to 30% by volume of graphite placed in an alcohol solution, ii) 1.0 to 5% surfactant, and iii) 40 to 70% water by volume, the process comprising:

mixing the graphite in alcohol solution with water; and mixing the surfactant into the graphite and water mixture.

7. A method of using a lubricant composition consisting essentially of i) 30 to 50% graphite in alcohol solution comprising between 10 to 30% by volume of graphite placed in an alcohol solution, ii) 1.0 to 5% surfactant, and iii) 40 to 70% water by volume, the method comprising:

applying the lubricant composition to a surface; and allowing the lubricant composition to dry.

8. The method of claim 7, wherein the lubricant composition is applied by a method selected from the group consisting of a brush, a spray, a person's hand, and a mechanical means.

9. The method of claim 7, wherein the lubricant composition is applied to a surface of an engine component.

10. The method of claim 9, wherein the lubricant composition is applied to a surface of an oil filter seal.

11. The method of claim 7, wherein the lubricant composition is applied to a surface to form a film less than 0.01 inches thick.

12. The method of claim 11, wherein the lubricant composition is applied to a surface to form a film 0.002 to 0.003 inches thick.

* * * * *